US006438760B1

(12) United States Patent
Wakefield et al.

(10) Patent No.: US 6,438,760 B1
(45) Date of Patent: Aug. 27, 2002

(54) NOVELTY HAT APPARATUS

(76) Inventors: Tony Wakefield, 221 Old Tusculum Rd., Antioch, TN (US) 37013; Jeremiah Wakefield, 141 Neese Dr., Gazebo Apartments, Nashville, TN (US) 37211

( * ) Notice: Subject to any disclaimer, the term of this patent is extended or adjusted under 35 U.S.C. 154(b) by 0 days.

(21) Appl. No.: 09/865,820

(22) Filed: May 25, 2001

(51) Int. Cl.[7] ..... A42B 1/24

(52) U.S. Cl. ..... 2/209.13; 2/422; 40/428; 99/421 A; 446/27

(58) Field of Search ..... 2/209.13, 422; 40/428; 99/419, 421 A; 446/27, 352, 353

(56) References Cited

U.S. PATENT DOCUMENTS 4,729,747 A * 3/1988 Yeh ..... 446/27
4,815,367 A * 3/1989 Hansen et al. ..... 99/421
4,857,031 A * 8/1989 Lucas ..... 446/481
6,256,795 B1 * 7/2001 Habel ..... 2/209.13
6,296,884 B1 * 10/2001 Okerlund ..... 426/104

* cited by examiner

*Primary Examiner*—Peter Nerbun
*Assistant Examiner*—Katherine Moran
(74) *Attorney, Agent, or Firm*—Waddey & Patterson; Guy W. Hensley

(57) ABSTRACT

A novelty hat apparatus having a spit for simulating the roasting of objects, a headpiece for supporting the apparatus on the head of a wearer, and a first and second spit frame member attached to the headpiece and extending upward therefrom, the first and second spit frame members each having apertures defined therein for receiving the ends of the spit. The headpiece has at least one simulated fire member attached to the headpiece and extending upward therefrom toward the spit. The apparatus may include a motor with a drive shaft extending therefrom and engaging a toothed wheel on the spit for turning the spit by operation of the motor. Additionally, a strap may be attached to the headpiece for retaining the apparatus on the head of the wearer. The spit may also have a spit crank fixed to an end.

16 Claims, 2 Drawing Sheets

NOVELTY HAT APPARATUS

BACKGROUND OF THE INVENTION

This invention relates to an apparatus to be worn by a wearer for simulating the spit-roasting of an object. The apparatus is similar to a hat in that it is worn on the head of a wearer, and includes a headpiece that is adjustable to the head of the wearer. The headpiece has at least one member attached thereon and extending upward to simulate flames of a fire.

The headpiece supports a spit that is suspended over the simulated fire member by means of a spit frame. The purpose of the present invention is to provide an apparatus whereby a wearer may demonstrate opposition to an opponent of a team or cause that the wearer supports, adding to the enjoyment of demonstrating such opposition. While the present invention is ideally suited for use at athletic events, any cause for which there is an opponent and an opportunity to express opposing views (e.g., political rallies) would be an appropriate use of the apparatus.

Especially with regard to athletics, it is known in the practice of making hats and the like to make such headgear to allow one to demonstrate support for one of a variety of athletic teams or causes. Typically, the headgear shows support for the athletic team supported by the wearer; however, few if any headpieces are designed or made to demonstrate opposition to an opponent of the team supported by the wearer. This is because there has been no efficient way to demonstrate opposition to a team represented on a headpiece. A particular team plays many different teams during the course of a season. As a result, it has historically been uneconomical to make hats or other headgear whereby a wearer may demonstrate opposition to each opponent of the team supported by the wearer. The present invention accomplishes such a goal.

SUMMARY OF THE INVENTION

The present invention incorporates a spit for holding an object, a frame supporting the spit, and a headpiece supporting the spit and spit frame on the head of a wearer. The object on the spit can be one of a variety of objects that can each be removably attached to the spit. The headpiece further has at least one member attached to the headpiece and extending upward toward the spit that has the purpose of simulating a fire that would be roasting the object on the spit. In a preferred embodiment, the apparatus will also include a powered drive system for rotating the spit by use of an electric motor and drive train system that will rotate the spit in a mechanized manner.

In light of the need for an apparatus to be worn by one desiring to express his or her support for a particular athletic team or organization by spit-roasting an object representing any of a plurality of opposing athletic teams or organizations, it is an object of the invention to provide a novelty hat apparatus to be worn by a wearer for simulating the spit-roasting of an object.

It is a further object of the invention to provide increased enjoyment to the wearer in the process of demonstrating opposition to the opponent of the team supported by the wearer.

It is a further object of the invention to provide a mechanized headpiece for demonstrating opposition to a group or position opposed by the wearer.

In addition to the foregoing, further objects, features, and advantages of the present invention should become more readily apparent to those skilled in the art upon a reading of the following detailed description in conjunction with the drawings, wherein there are shown and described illustrated embodiments of the invention.

BRIEF DESCRIPTION OF THE INVENTION

DETAILED DESCRIPTION OF THE PREFERRED EMBODIMENT

Figure 1:
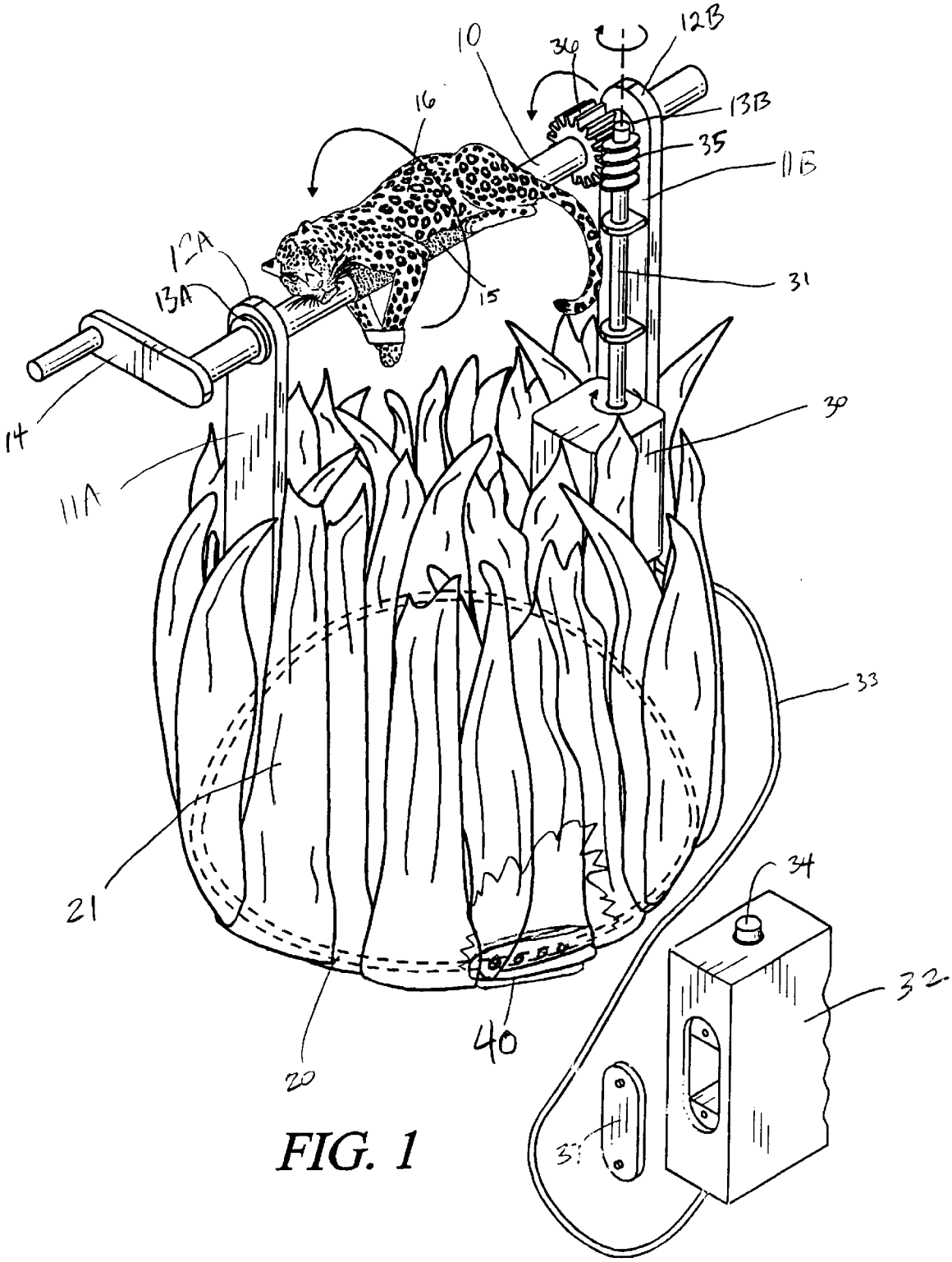
FIG. 1 is a perspective view of an embodiment of the invention.

Referring to FIG. 1, a spit 10 for holding an object to be roasted is supported on a spit frame comprising two spit frame members 11A and 11B. Spit frame members 11A and 11B support spit 10 in that each spit frame member has an upper end 12A and 12B, respectively, and each end 12A and 12B has an aperture 13A and 13B, respectively, for receiving and holding the spit.

Further referring to FIG. 1, spit 10 also includes a crank 14 attached to one end of the spit for simulating the crank of a known spit. Crank 14 is primarily included to aid in visual identification of the apparatus as a spit-roasting simulation. Spit 10 also preferably includes a strip of attaching material 15 disposed on spit 10 at a point near the midpoint of spit 10 for attaching cloth or other attachable objects to the spit.

As shown in FIG. 1, the invention includes an object 16 attached to strip 15 on spit 10. While the object shown in FIG. 1 is a jaguar, any of a plurality of objects may be attached to strip 15 to simulate any of a plurality of objects to be simulatingly spit-roasted. For example, in a preferred embodiment of the invention, a variety of such objects would be provided for support of a particular athletic team by demonstrating opposition to other teams in the same league, each of which would be represented by any one of the plurality of objects in the set, each such object being enabled to being removably attached to strip 15 on spit 10.

Further referring to FIG. 1, spit frame members 11A and 11B are supported at the lower ends of spit frame members 11A and 11B by a headpiece 20 which has the purpose of supporting the apparatus on the head of a wearer. Headpiece 20 further includes at least one simulated fire member 21 attached to the headpiece and extending up toward spit 10. In order to make the headpiece adjustable to the hat sizes of different wearers, headpiece 20 also includes a headband adjustment clasp 40 for adjustably fitting the headpiece to the head of the wearer. Headband adjustment clasp 40 is similar to those seen on the back of commercially available baseball caps and the like.

Further referring to FIG. 1, headpiece 20 is shown as a skullcap-type headpiece supporting the spit and spit frame. However, there are many suitable headpieces that could perform the functions of headband 20 equally as well as headpiece 20 does, such as a wig or a headband. Any headpiece that supports the rest of the apparatus while simultaneously simulating the fire above the headpiece is sufficient to accomplish the objects of the invention.

While headpiece 20, spit frame members 11A and 11B, and spit 10 form the basic components of the present invention, the invention also preferably includes a powered drive system for mechanically rotating the spit automatically and continually. Referring to FIG. 1, such a powered drive system includes an electric motor 30 and a drive shaft 31 extending from the motor to engage spit 10 so that spit 10 is rotated by the operation of electric motor 30 and drive shaft 31. Electric motor 30 may be powered by any of a number of conventional means such as battery power or solar power.

Also in a preferred embodiment of the invention, the power supply may be contained in a power supply box 32, which is connected by an electric cord 33 to electric motor 30. Power supply box 32 also preferably includes an on/off switch such as a push button switch 34 to control the operation of electric motor 30. A screw plate 39 is shown as the means for accessing the power source inside power supply box 32; however, many other types of conventional means for accessing the interior of power supply box 32 are possible.

Further referring to FIG. 1, the drive train system extending from electric motor 30 comprises a drive shaft 31 extending from the motor upward to culminate in a drive head 35. The purpose of drive head 35 is to engage the spit to rotate the spit. In a preferred embodiment, drive head 35 comprises a pitched, threaded portion that engages the spit to further enable rotation of the spit by operation of electric motor 30. Spit 10 also preferably includes a toothed wheel 36 axially mounted on the spit. The purpose of toothed wheel 36 is to be engaged by drive head 35 such that operation of electric motor 30 and drive shaft 31 may turn drive head 35 to engage toothed wheel 36 and thus rotate the spit by operation of electric motor 30.

Figure 2:
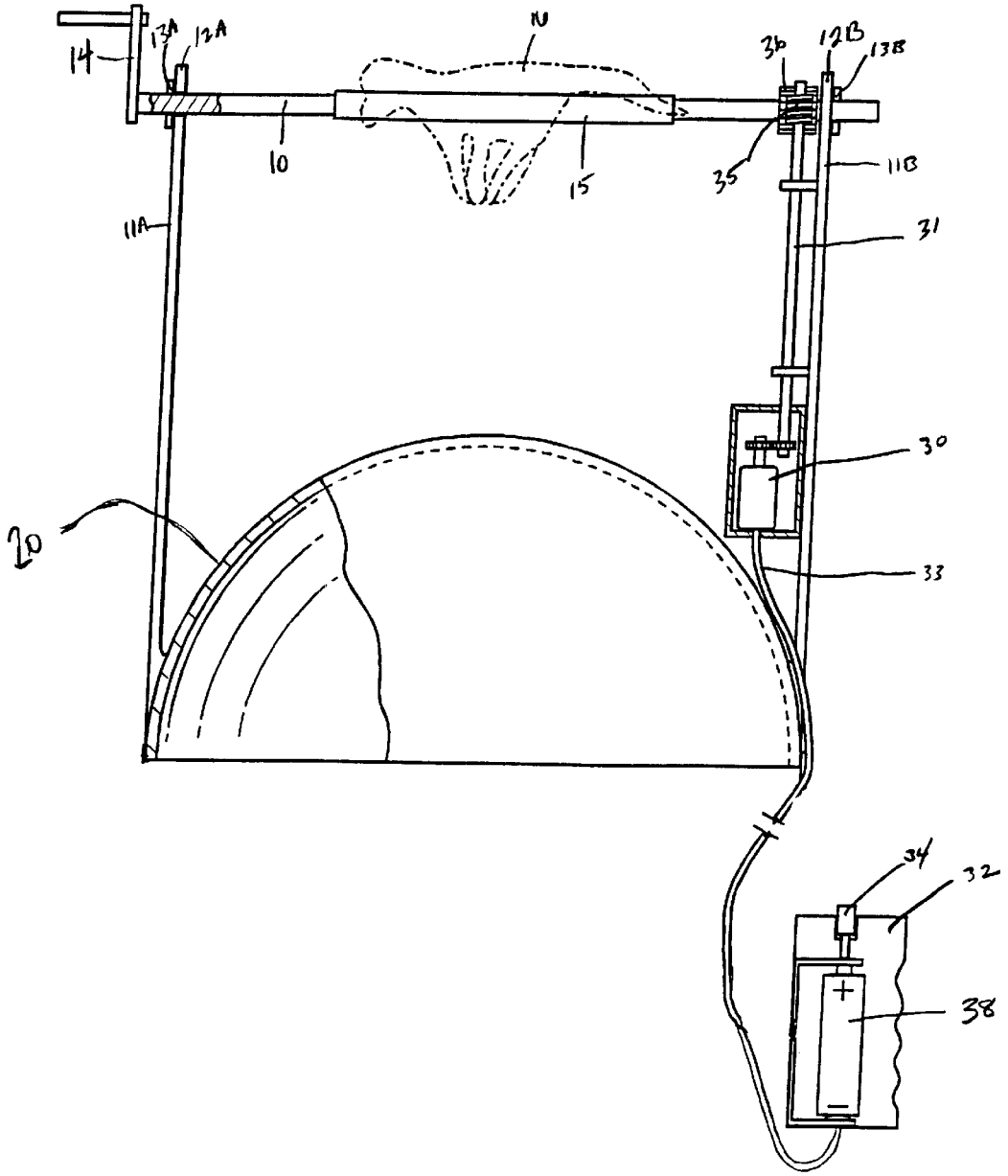
FIG. 2 is a plan view of an embodiment of the invention.

Referring to FIG. 2, another embodiment of the present invention is shown. All of the basic features of the invention are shown as described above relating to FIG. 1, with several exceptions. First, object 16 is not defined as a particular type of object, but as a "ghost" object representing the versatility of the embodiment of object 16. Second, headpiece 20 is shown in a manner that is more revealing of the skullcap configuration than headpiece 20 as shown in FIG. 1. It should be noted again that any type of headpiece is acceptable so long as it properly supports spit 10, spit frame members 11A and 11B, and the motorized drive system as shown in FIGS. 1 and 2 and described herein.

Finally, in FIG. 2, the inner workings of a preferred embodiment of electric motor 30 are shown. It should be noted that so long as electric motor 30 accomplishes the rotating of drive shaft 31, the particular embodiment shown in FIG. 2 is not limiting on those practicing the invention. Moreover, the source of power in FIG. 2 is shown as an alkaline or non-alkaline battery cell 38 inside power supply housing 32. As long as the power supply accomplishes the objects of the invention, any power supply configuration is acceptable as mentioned above. The power supplied to electric motor 30 could be supplied by a battery, a solar cell, or any other supply that accomplishes the objects of the present invention.

The present invention can also be described in terms of a kit for a novelty hat apparatus to be worn by a wearer for simulating the spit-roasting of an object. The elements of the kit would include a spit, a headpiece, and spit frame for supporting the spit from the headpiece and a plurality of detachable dolls constructed to be detachably mounted on the spit.

Thus it is seen that the apparatus and methods of practicing the present invention readily achieve the ends and advantages mentioned, as well as those inherent therein. While certain preferred embodiments have been illustrated and described for purposes of the present disclosure, numerous changes in parts and steps may be made by those skilled in the art, which changes are encompassed within the scope and spirit of the intended claims.

We claim:

1. A novelty hat apparatus to be worn by a wearer for simulating the spit-roasting of an object, comprising:

a spit for holding the object to be roasted;

a headpiece for supporting the apparatus on the head of the wearer, the headpiece having at least one simulated fire member attached to the headpiece and extending from the headpiece upward toward the spit; and a frame supporting the spit from the headpiece.

2. The apparatus of claim 1, further comprising a powered drive system for rotating the spit.

3. The apparatus of claim 2, wherein the powered drive system comprises:

an electric motor; and a drive train extending from the motor and engaging the spit, so that the spit is rotated by the electric motor and the drive train.

4. The apparatus of claim 3, wherein the electric motor is battery-powered.

5. The apparatus of claim 3, wherein the electric motor is solar-powered.

6. The apparatus of claim 3, further comprising an on/off switch for controlling the operation of the motor.

7. The apparatus of claim 3, wherein the drive train further comprises a drive shaft extending from the motor, the drive shaft ending in a drive head, the drive head drivably engaging the spit for rotating the spit.

8. The apparatus of claim 7, wherein the drive head comprises a pitched, threaded portion engaging the spit for rotation of the spit.

9. The apparatus of claim 8, wherein the spit further comprises a toothed wheel axially mounted on the spit, the toothed wheel engaging the drive head for rotating the spit.

10. The apparatus of claim 1, further comprising at least one detachable doll for removably attaching to the spit.

11. The apparatus of claim 1, wherein the headpiece further comprises an adjustable headband for adjustably fitting the headpiece to the head of the wearer.

12. The apparatus of claim 1, further comprising a strap attached to the headpiece for retaining the apparatus on the head of the wearer.

13. The apparatus of claim 1, wherein the frame further comprises:

a first spit frame member having a lower end and an upper end, the lower end being attached to the headpiece, and the upper end having an aperture defined therein for receiving a first end of the spit; and a second spit frame member having a lower end and an upper end, the lower end having an aperture defined therein for receiving a second end of the spit.

14. The apparatus of claim 1, further comprising a crank attached to the second end of the spit.

15. A novelty hat apparatus to be worn by a wearer for simulating the spit-roasting of an object, comprising:

a spit for holding the object to be roasted, the spit having a first end and a second end, the spit further having a toothed wheel axially mounted on the first end of the spit, and a crank attached to the second end of the spit;

a headpiece for supporting the apparatus on the head of the wearer, the headpiece having at least one simulated fire member attached to the headpiece and extending from the headpiece upward toward the spit, the headpiece further comprising an adjustable headband for adjustably fitting the headpiece to the head of the wearer;

a spit frame supporting the spit from the headpiece, the spit frame further including:

a first spit frame member having a lower end and an upper end, the lower end being attached to the headpiece, and the upper end having an aperture defined therein for receiving the first end of the spit; and a second spit frame member having a lower end and an upper end, the upper end having an aperture defined therein for receiving the second end of the spit;

a powered drive system for rotating the spit, the drive system including:

an electric motor;

an on/off switch for controlling the operation of the motor; and a drive train extending from the electric motor and engaging the spit for rotating the spit, the drive train including a drive shaft extending from the motor, the drive shaft ending in a drive head, the drive head having a pitched, threaded portion for engaging the spit for rotation of the spit, the pitched, threaded portion drivably engaging the toothed wheel on the spit for rotating the spit;

a strap attached to the headpiece for retaining the apparatus on the head of the wearer; and at least one detachable doll for removably attaching to the spit.

16. A kit for a novelty hat apparatus to be worn by a wearer for simulating the spit-roasting of an object, comprising:

a spit;

a headpiece;

a spit frame for supporting the spit from the headpiece; and a plurality of detachable mascot dolls constructed to be detachably mounted on the spit.

* * * * *